US007237514B2

(12) United States Patent
Tawarada et al.

(10) Patent No.: US 7,237,514 B2
(45) Date of Patent: Jul. 3, 2007

(54) PISTON COOLING DEVICE

(75) Inventors: Yuichi Tawarada, Saitama (JP); Isamu Takahashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/315,251

(22) Filed: Dec. 23, 2005

(65) Prior Publication Data

US 2006/0144352 A1 Jul. 6, 2006

(30) Foreign Application Priority Data

Dec. 27, 2004 (JP) ..... 2004-375590

(51) Int. Cl.
*F01P 1/04* (2006.01)

(52) U.S. Cl. ..... 123/41.35

(58) Field of Classification Search ..... 123/41.35, 123/41.34, 41.39, 41.36, 41.37, 41.38
See application file for complete search history.

(56) References Cited

U.S. PATENT DOCUMENTS 3,709,109 A 1/1973 Howe
4,206,726 A 6/1980 Johnson, Jr. et al.
5,092,292 A 3/1992 Iguchi et al.
6,205,971 B1 * 3/2001 Inumaru et al. ..... 123/196 R

FOREIGN PATENT DOCUMENTS

EP 1 288 460 A1 3/2003
JP 6-264742 A 9/1994
JP 2003-74347 A 3/2003

* cited by examiner

*Primary Examiner*—Stephen K. Cronin
*Assistant Examiner*—Hyder Ali
(74) *Attorney, Agent, or Firm*—Birch, Stewart, Kolasch, & Birch, LLP

(57) ABSTRACT

A cooling structure is a separate member from a structural portion of an engine. An oil injection pipe includes cooling oil injection holes for injecting cooling oil into cylinder bores and is mounted across an engine at a somewhat upper position with respect to a crank shaft and in parallel with the crank shaft. Both ends of the oil injection pipe are fixed through mounting members to right and left side walls of the engine, whereby the pipe is mounted. Two left and right pipe portions are joined together at a central position between the two to constitute the oil injection pipe as a single pipe. At the connection in the central position, the oil injection pipe is connected to an oil supply path. Oil supplied through the oil supply path flows into the left and right pipe portions and is injected from the injection holes into the cylinder bores.

20 Claims, 9 Drawing Sheets

SECTIONAL VIEW TAKEN ON LINE XI-XI

PISTON COOLING DEVICE

CROSS-REFERENCE TO RELATED APPLICATIONS

The present application claims priority under 35 USC 119 to Japanese Patent Application No. 2004-375590 filed on Dec. 27, 2004 the entire contents of which are hereby incorporated by reference.

1. Field of the Invention

The present invention relates to a piston cooling device in an internal combustion engine.

2. Description of Background Art

Cooling of a piston in an internal combustion engine is usually performed by direct injection of cooling oil into a cylinder bore through which the piston slides and reciprocates. An oil injection hole is opened to a journal wall of a journal bearing portion for a crank shaft between a pair of cylinder bores. The supply of oil to the oil injection hole is performed through a branch oil path extending through the journal bearing portion. See, for example, Japanese Patent Laid-Open No. 2003-74347 pages 3–5 and FIG. 4.

Japanese Patent Laid-Open No. 2003-74347 discloses a four-cylinder internal combustion engine. A crank shaft is supported by a crank case through journal bearing portions disposed at five positions, and an oil supply path branched from a main gallery extends to each journal bearing portion to supply oil through the branch supply path to each journal bearing portion. Further, an oil injection hole for the injection of oil into a cylinder bore is open to a journal wall of each journal bearing portion and is in communication with the oil supply path in each journal bearing portion to inject oil into the cylinder bore.

In Japanese Patent Laid-Open No. 2003-74347 there are four cylinder bores and the injection of cooling oil into the cylinder bores is performed through an injection hole formed in a journal wall between a pair of cylinder bores. However, it is difficult to effect machining for the injection port to be formed in the journal wall. In addition, the formation of an injection hole formed for each cylinder bore and the formation of an oil supply path for the injection hole requires a relatively high machining accuracy, thus leading to an increase in the number of machining steps and deterioration of the working efficiency. Moreover, in the case where the number of cylinders becomes still larger, the formation of an oil injection hole in the journal wall and the formation of an oil supply path for the injection hole require additional work.

Under the above-mentioned circumstances, a demand exists for the provision of an improved structure of the piston cooling device that is capable of being obtained easily and inexpensively and is able to form an oil injection hole for the injection of cooling oil into a cylinder bore and an oil supply path for the supply of oil to the injection hole and attain a great improvement in the working efficiency for forming the injection hole and oil supply path while ensuring a relatively high accuracy of the oil injection hole and the oil supply path.

SUMMARY AND OBJECTS OF THE INVENTION

The present invention is concerned with the provision of a piston cooling device for solving the above-mentioned problems. According to a first aspect of the invention there is provided a piston cooling device in an internal combustion engine having a piston cooling structure which injects oil into a cylinder bore, including an oil injection pipe having an oil injection hole for injection of the oil. The oil injection pipe is disposed on an extension line of the cylinder bore in parallel with a crank shaft in a side view of the engine.

A second aspect of the present invention is directed to the oil injection pipe that is formed separately from a structural portion of the engine and is inserted and mounted in a vehicular transverse direction into a crank case of the engine.

A third aspect of the present invention is directed to the oil injection pipe that is provided at an end portion thereof with a mounting member for the oil injection pipe being mounted to a crank case of the engine through the mounting member, and an oil injecting direction is determined by determining a relative relation between the oil injection pipe and the mounting member.

A forth aspect of the present invention is directed to the oil injection pipe that is formed in a divided manner and is inserted and mounted in a vehicular transverse direction into the crank case with the mounting member being provided at each of right and left ends of the oil injection pipe. The mounting members provided at the right and left ends of the oil injection pipe being different from each other in the distance from the oil injection pipe to each of respective clamping positions.

A fifth aspect of the present invention is directed to an orifice having a plurality of small-diameter holes that is provided in an intermediate position of an oil supply path for the supply of oil to the oil injection pipe.

A sixth aspect of the present invention is directed to an outside diameter and an inside diameter of the oil injection pipe that are offset from each other. The oil injection hole is formed in a thick-wall portion of the oil injection pipe.

Further, a seventh aspect of the present invention is directed to the oil path to the oil injection pipe that is an oil path used exclusively for the injection of oil and branching from near a downstream side of an oil filter.

According to the first aspect of the present invention, in an internal combustion engine having a piston cooling structure that includes an oil injection pipe having an oil injection hole for injection of the oil, the oil injection pipe is disposed on an extension line of the cylinder bore in parallel with a crank shaft in a side view of the engine. Therefore, in comparison with the case where the oil injection hole is formed directly in the crank case or the cylinder block, the oil injection hole can be formed in a simple manner and the plurality of oil injection holes can be formed easily particularly in the case of multiple cylinders. Thus, it is possible to reduce the cost for forming the oil injection hole(s).

According to the second aspect of the present invention, the oil injection pipe is formed separately from a structural portion of the engine and is inserted and mounted in a vehicular transverse direction into a crank case of the engine. Therefore, the oil injection hole can be easily provided in the engine by the insertion of the oil injection pipe. More particularly, in comparison with forming an oil injection hole in a crank case or a cylinder block for each cylinder in the case of multiple cylinders, the oil injection hole can be formed in the engine in a simple manner and thus it is possible to reduce the cost for forming the injection hole.

According to the third aspect of the present invention, the oil injection pipe is provided at an end portion thereof with a mounting member for the oil injection pipe and is mounted to a crank case of the engine through the mounting member. An oil injecting direction is determined by determining a relative relation between the oil injection pipe and the mounting member, therefore, the oil injecting direction can be determined by adjusting the mounting member and can be changed by changing the specification. In addition, no special member is needed for positioning the oil injection pipe.

According to the forth aspect of the present invention, the oil injection pipe is formed in a divided manner and is inserted and mounted in a vehicular transverse direction into the crank case. The mounting member is provided at each of right and left ends of the oil injection pipe with the mounting members that are provided at the right and left ends of the oil injection pipe being different from each other in the distance from the oil injection pipe to each of respective clamping positions. Therefore, it is possible to prevent an erroneous mounting at the time of mounting the oil injection pipe. In addition, since the pipe is divided, machining on the case side is easy even in the case where the number of cylinders is large.

According to the fifth aspect of the invention, since an orifice having a plurality of small-diameter holes is provided in an intermediate position of an oil supply path for the supply of oil to the oil injection pipe, a filtering effect is obtained by the small-diameter holes of the orifice.

According to the sixth aspect of the present invention, an outside diameter and an inside diameter of the oil injection pipe are offset from each other, and the oil injection port is formed in a thick-wall portion of the oil injection hole. Therefore, an oil approach-run distance can be ensured while reducing the diameter of the oil injection pipe. Consequently, it is possible to attain a reduction in the size and weight of the oil injection pipe and to allow the injected oil to have directivity, whereby the cooling of a desired position can be effected positively.

According to the seventh aspect of the invention, since the oil path to the oil injection pipe is an oil path used exclusively for the injection of oil and branching from near a downstream side of an oil filter, the oil just after filtered by the oil filter can be utilized in the injection of oil.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described hereinunder with reference to FIGS. 1 to 11.

Figure 1:
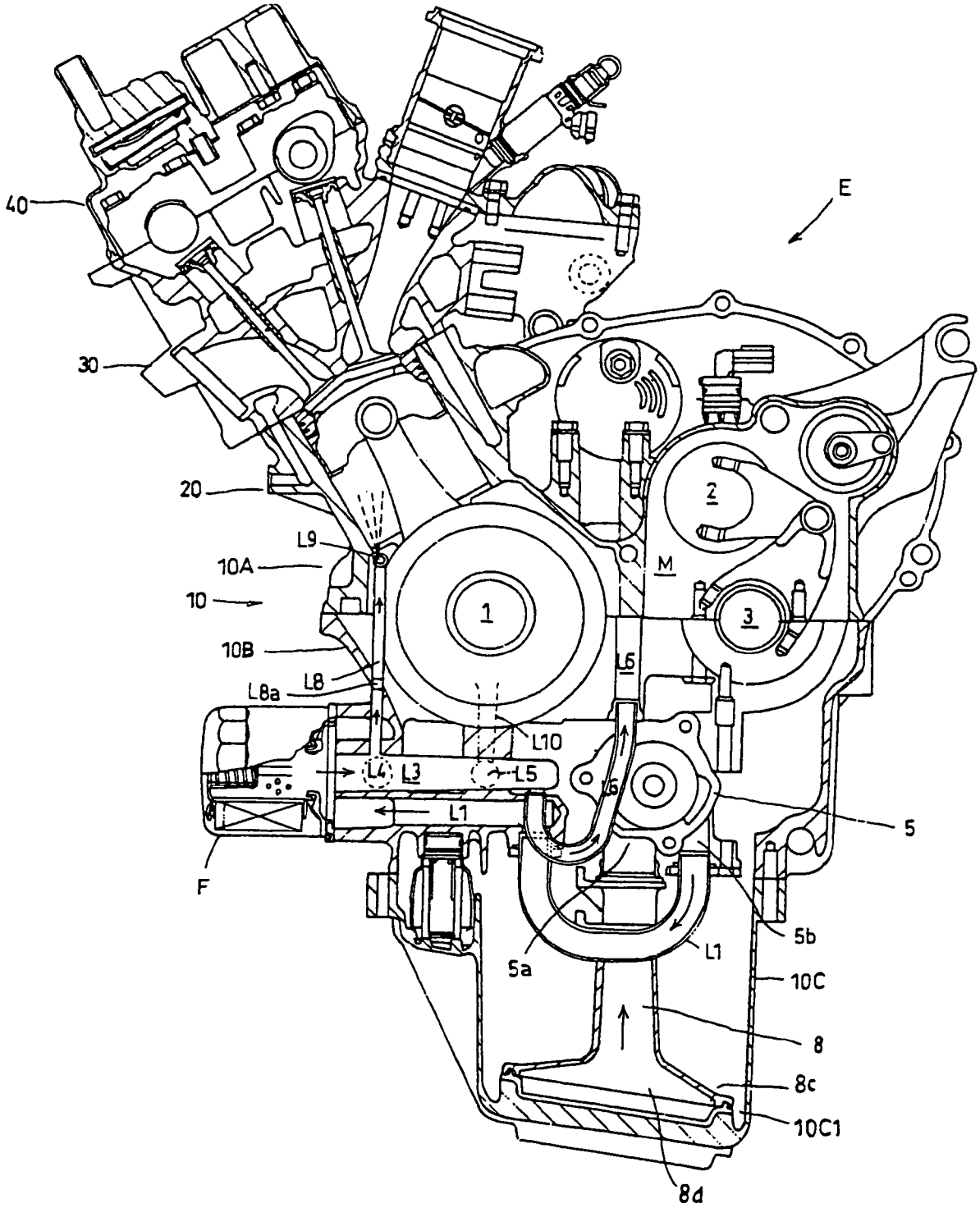
FIG. 1 is a sectional side view of a principal portion of an internal combustion engine provided with a piston cooling device according to the present invention.
Figure 2:
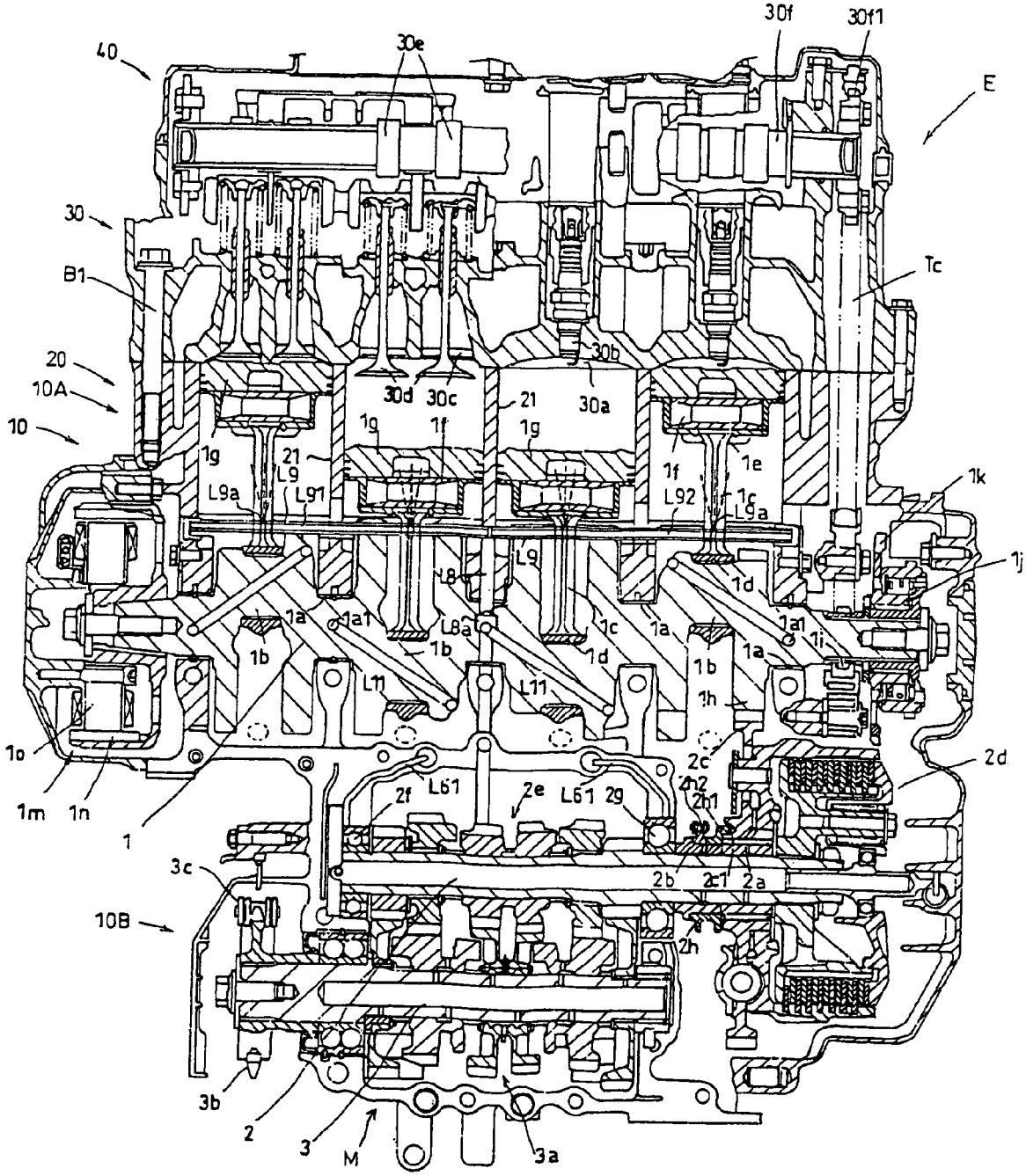
FIG. 2 is a longitudinal sectional view thereof.

FIG. 1 is a sectional side view of an internal combustion engine E related to this embodiment and FIG. 2 is a longitudinal sectional view thereof.

Referring to FIG. 1, in the internal combustion engine E, a cylinder block 20 in the engine E is formed integrally in an upper portion of a crank case 10 and a cylinder head 30 is provided in such a manner that a lower portion thereof is fixed to an upper portion of the cylinder block 20. Further, a cylinder head cover 40 which covers an upper portion of the cylinder head 30 is provided on top of the cylinder head 30. These structural components are joined and fixed to one another into an integral mass by means of clamping bolts B1 (see FIG. 2), thus constituting a principal structural portion of the internal combustion engine E.

The crank case 10 has a vertically bisplit structure in FIG. 1, in which it is vertically divided into an upper case 10A and a lower case 10B. The cylinder block 20 is integral with the upper case 10A, while an oil pan 10C is attached to a lower portion of the lower case 10B. Referring also to FIG. 2, a crank shaft 1 is rotatably supported in a joined portion of the upper and lower cases 10A, 10B through journal bearing portions 1*a* disposed at five positions.

Connecting rods 1*c* are connected through respective large ends 1*d* to four crank pins 1*b* in the crank shaft 1. Pistons 1*g* are secured to small ends 1*e* of the connecting rods 1*d* through piston pins If. The pistons 1*g* are adapted to slide and reciprocate through the interiors of cylinder bores 21 formed in the cylinder block 20. These structures themselves are already well known.

A driving gear 1*h* is mounted on the crank shaft 1 at a position close to the right end in the longitudinal direction in the drawing. The gear 1*h* is in mesh with a driven gear 2*c* which is supported on a main shaft 2 of a transmission so as to be relatively rotatable with respect to the main shaft 2 through a sleeve 2*a*. A driving force is transmitted from the driven gear 2*c* to the main shaft 2 through a shift clutch 2*d* and is also transmitted to a counter shaft 3 through a selective gear engagement of shift gears 2*e* and 3*a* on the main shaft 2 and the counter shaft 3. The driving force thus transmitted to the counter shaft 3 is further transmitted to rear wheels as vehicular driving wheels (not shown) through a drive chain 3*c* by means of a driving sprocket 3*b*.

A sprocket 1*i* is provided on the crank shaft 1, the sprocket 1*i* is of a small diameter and is adjacent to the journal bearing portion 1*a* located near the driving gear 1*h* close to the right end of the crank shaft. The sprocket 1*i* is a sprocket for driving a cam shaft 30*f*. A timing chain Tc is entrained on the sprocket 1*i* and also on two sprockets 30*f*1 mounted respectively on right ends of two cam shafts 30*f* which are disposed in the upper portion of the cylinder head 30. The cam shaft 30*f* is rotated at a decelerated (½) speed of the speed of the crank shaft 1. A space for rotation and travel of the timing chain Tc is formed through the crank case 10, the cylinder block 20 integral with the crank case 10 and further through the cylinder head 30.

A gear 1*k* for the starter is mounted outside the cam shaft driving sprocket 1*i* on the crank shaft 1, i.e., substantially at a right end position of the crank shaft 1, through a one-way clutch 1*j*. Further, a rotor in of a generator 1*m* is fixed to the left end of the crank shaft 1 and a stator 1*o* of the generator 1*m* is attached to a side wall portion of the crank case 10.

As described earlier, the cylinder block 20 is integrally formed in the upper portion of the upper case 10A. The four cylinder bores 21 are formed in the cylinder block 20 and the pistons 1*g* slide and reciprocate through the cylinder bores 21. Four combustion chambers 30*a* are formed in the lower portion of the cylinder head 30 which is fixed to the upper portion of the cylinder block 20, and spark plugs 30*b* are disposed in the combustion chambers 30*a*, respectively. Openings 30*c* for intake and exhaust are formed and intake and exhaust valves 30*d* for opening and closing the openings 30*c* are disposed therein. Further, a valve operating mechanism including cams 30*e* and a cam shaft 30*f* for opening and closing the intake and exhaust valves 30*d* is provided in the cylinder head 30 and the upper portion of the cylinder head 30 is covered with a head cover 40.

The main shaft 2 in the transmission is rotatably supported in the lower case 10B of the crank case 10 through two ball bearings 2*f* and 2*g* and a plurality of shift gears 2*e* are provided on the shaft portion between the two ball bearings 2*f* and 2*g*. Further, a sprocket 2*h*, which is supported relatively rotatably with respect to the shaft 2 through a sleeve 2*b*, is mounted outside the right-hand bearing portion in FIG. 2 of the shaft 2 and at a position adjacent to the driven gear 2*c*.

The sprocket 2*h* is adapted to rotate in interlock with rotation of the driven gear 2*c* which is adjacent to the sprocket 2*h*. Therefore, the sprocket 2*h* has an annular collar portion 2*h*2 formed with a projecting engaging portion 2*h*1 on the right side in the drawing. The projecting engaging portion 2*h*1 is engaged with an engaging recess 2*c*1 formed in a left side in the drawing of the driven gear 2*c*.

On the main shaft 2, the sprocket 2*h*, supported relatively rotatably with respect to the shaft 2, is drivingly connected through a chain 2*i* to a sprocket 4A which is mounted using a structure to be described later to a right end 4*a* of a pump driving shaft 4 of an oil pump 5 shown in FIG. 3. Therefore, the oil pump 5 having the pump driving shaft 4 is disposed within the lower case 10B of the crank case 10 so as to be positioned as the shaft 4 extending in parallel with the main shaft 2 within the lower case 10B.

The oil pump driving shaft 4 constitutes an inner rotor of the oil pump 5 which is a trochoid type pump. The inner rotor is engaged with an outer rotor which slides and rotates within pump cases 5A and 5B as stationary portions of the oil pump 5, whereby oil is fed under pressure to various portions of the internal combustion engine E. More specifically, a star-shaped outer rotor and an inner rotor smaller by one in the number of blades than the outer rotor rotate separately within the pump cases 5A and 5B and the resulting change in volume generates an oil pressure, whereby the pressurized oil is fed to various portions of the engine E. The oil pump 5 used in this embodiment may be a gear pump. As to the supply of oil to various portions of the internal combustion engine E, a description will be given later.

Figure 3:
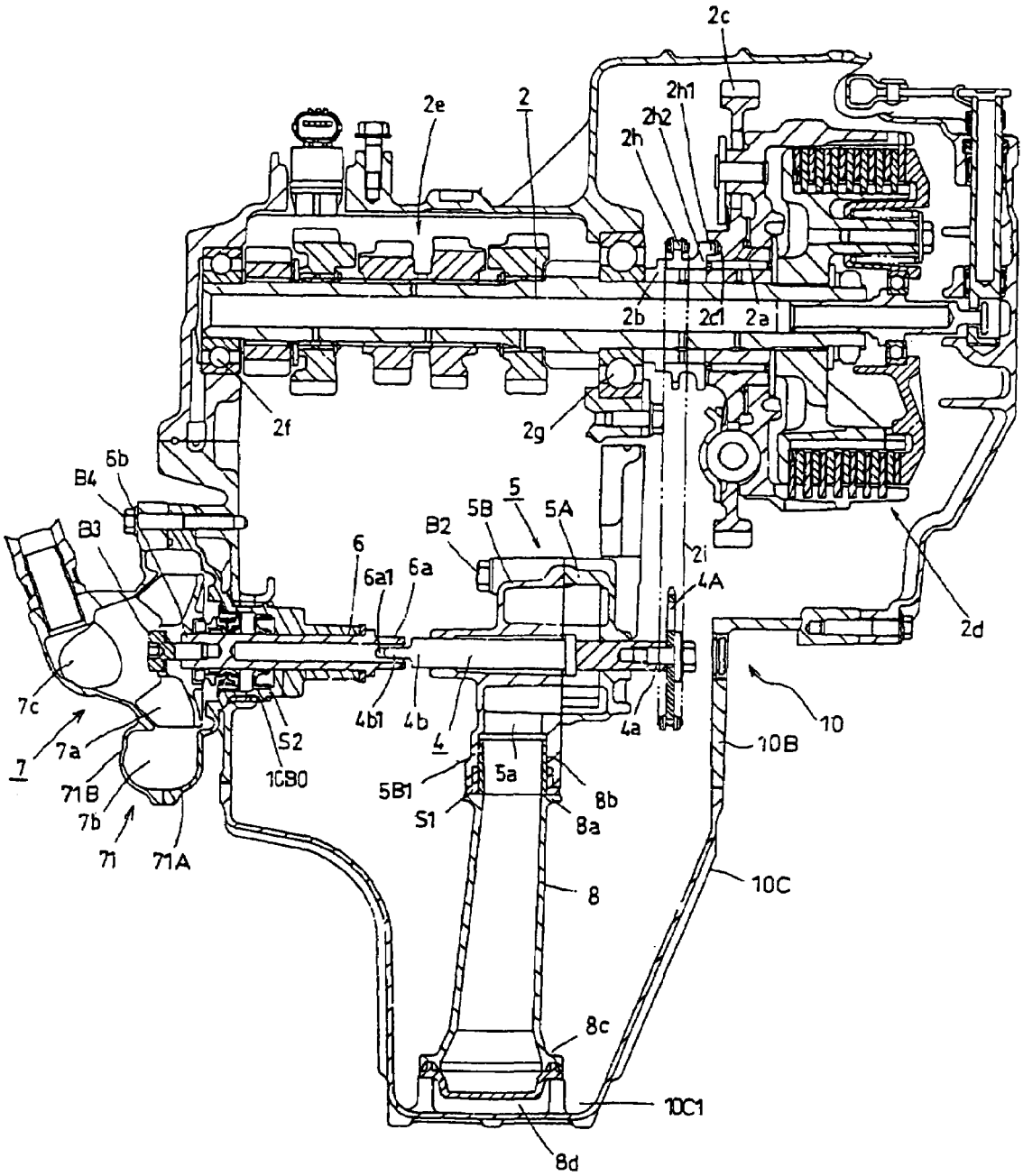
FIG. 3 illustrates the structure of a lower portion of the internal combustion engine.

As to the bisplit pump cases 5A and 5B which are stationary portions of the oil pump 5, the case 5B located on the left side in FIG. 3 is fixed and supported at its lower portion to an upper portion of an oil strainer 8 which projects from a bottom 10C1 of the oil pan 10C. More specifically, the oil strainer 8 is formed as a tapered cylindrical body having a lower portion as a connection with the bottom 10C1 of the oil pan 10C that is somewhat thick and having an upper portion that is somewhat thin. A flange 8*a* is formed on the upper portion of the oil strainer 8 and a straight cylindrical portion 8*b* projects from the flange 8*a*. A lower projecting cylindrical portion 5B1 of the left-hand pump case 5B is fitted from the outside onto the straight cylindrical portion 8*b* through a sealing member S1, whereby it is fixed and is supported on the upper portion of the strainer 8. Both right and left pump cases 5A and 5B are fixed to each other by a clamping bolt B2 and the oil pump 5 is clamped to the crank case 10 from below using clamping bolts.

The sprocket 4A for driving the oil pump 5 is mounted on the right end 4*a* of the pump driving shaft 4, while a left end 4*b* of the oil pump driving shaft 4 is connected to a pump driving shaft 6 of a water pump 7. The pump driving shaft 6 of the water pump 7 that is connected to the left end 4*b* of the oil pump driving shaft 4 is connected at one end thereof, i.e., at a right end 6*a* thereof, to the left end 4*b* of the oil pump driving shaft 4. This connection is in a mutually joined relation in the rotational direction, but a relative movement in the axial direction is allowed although it is within a slight range. Therefore, the left end 4*b* of the oil pump driving shaft 4 is scraped off into a plate-like projecting portion 4*b*1, while the right end 6*a* of the water pump driving shaft 6 is cut out in a concave shape to form a recess 6*a*1 for receiving the plate-like projecting potion 4*b*1 therein.

A pump impeller 7*a* is mounted on the opposite end, i.e., the left end 6*b*, of the pump shaft 6 of the water pump 7. More specifically, a rotational center of the impeller 7*a* is aligned with the left end 6*b* of the pump driving shaft 6 and then the impeller is fixed with a clamping bolt B3. The impeller 7*a* rotates within a pump casing 71 and functions to suck in cooling water, increase the pressure of the sucked cooling water and discharge the pressurized cooling water from the pump. The discharged cooling water is fed for cooling to various portions of the internal combustion engine E.

The water pump 7 is provided with a casing 71 which is divided in two. The casing 71 includes a right casing 71A of a pump chamber 7*b* which is integral with an annular cylindrical casing including large and small cylindrical portions and an outer casing 71B which forms the pump chamber 7*b* together with the right casing 71A and which is provided with a cooling water suction port 7*c*. The right casing 71A and the outer casing 71B of the casing 71 are clamped integrally to an outer wall side of the lower case 10B of the crank case 10 with use of a clamping bolt B4. A reduced-diameter portion of the right casing 71A is fitted and supported in a wall opening 10B0 of the lower case 10B, whereby the pump 7 is secured to the lower case 10B.

According to the above layout structure of the oil pump 5 and the water pump 7, the rotation of the crank shaft 1 is transmitted from the driving gear 1*h* to the pump driving sprocket 2*h* through the driven gear 2*c* on the main shaft 2, and is then further transmitted from the sprocket 2*h* through driving by the chain 2*i* to the sprocket 4A on the end 4*a* of the oil pump driving shaft 4 to operate the shaft 4, whereby the oil pump 5 and the water pump 7 interlocked therewith and can be rotated. While the engine E is in operation, the rotation of both the oil pump 5 and water pump 7 is continued irrespective of whether the shift clutch 2*d* on the main shaft 2 is engaged or released.

With reference to FIGS. 1 to 5, a description will be given below concerning the structure of an oil supply path (pipe) for the supply of oil to various portions of the internal combustion engine E with the oil pump 5 and also about the flow of oil supplied through the oil supply path.

As described above, the oil pump 5 is mounted to the upper portion of the oil strainer 8 and is constituted by a somewhat tapered cylindrical body projecting upward from the bottom 10C1 of the oil pan 10C. In a lower portion 8*c* of the oil strainer 8 is formed a suction port 8*d* for the suction of oil which accumulates in the bottom 10C1 of the oil pan 10C. In the upper portion of the oil strainer 8 is provided a connecting portion for connection to the suction port 5*a* of the oil pump 5. Further, one end of a first oil supply path L1 is connected to a discharge port 5*b* (see FIGS. 1 and 4), while an opposite end of the first oil supply path L1 is connected to an inlet port of an oil filter F.

Figure 4:
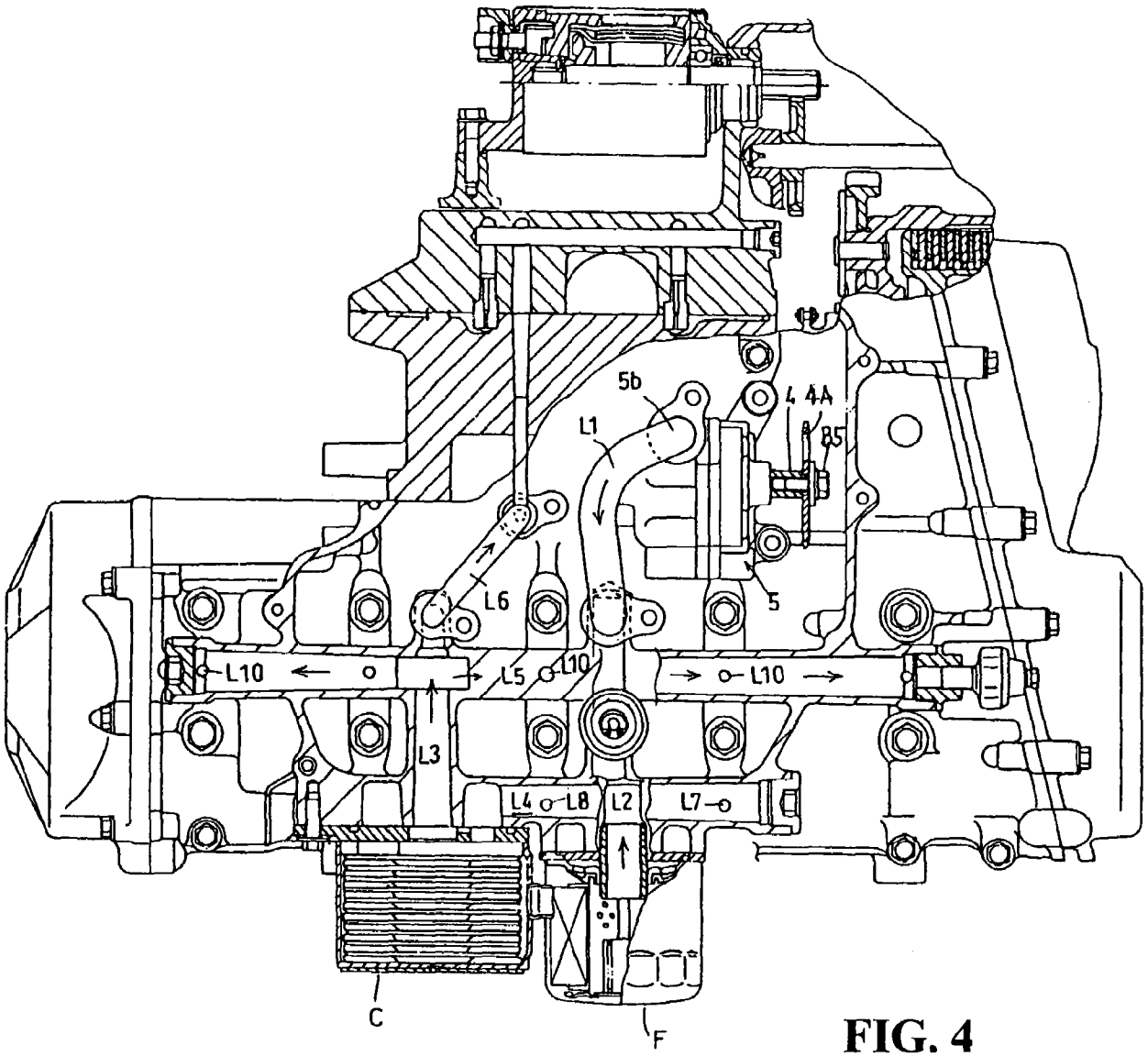
FIG. 4 is a sectional view of a principal portion, showing partially oil supply paths in the internal combustion engine.
Figure 5:
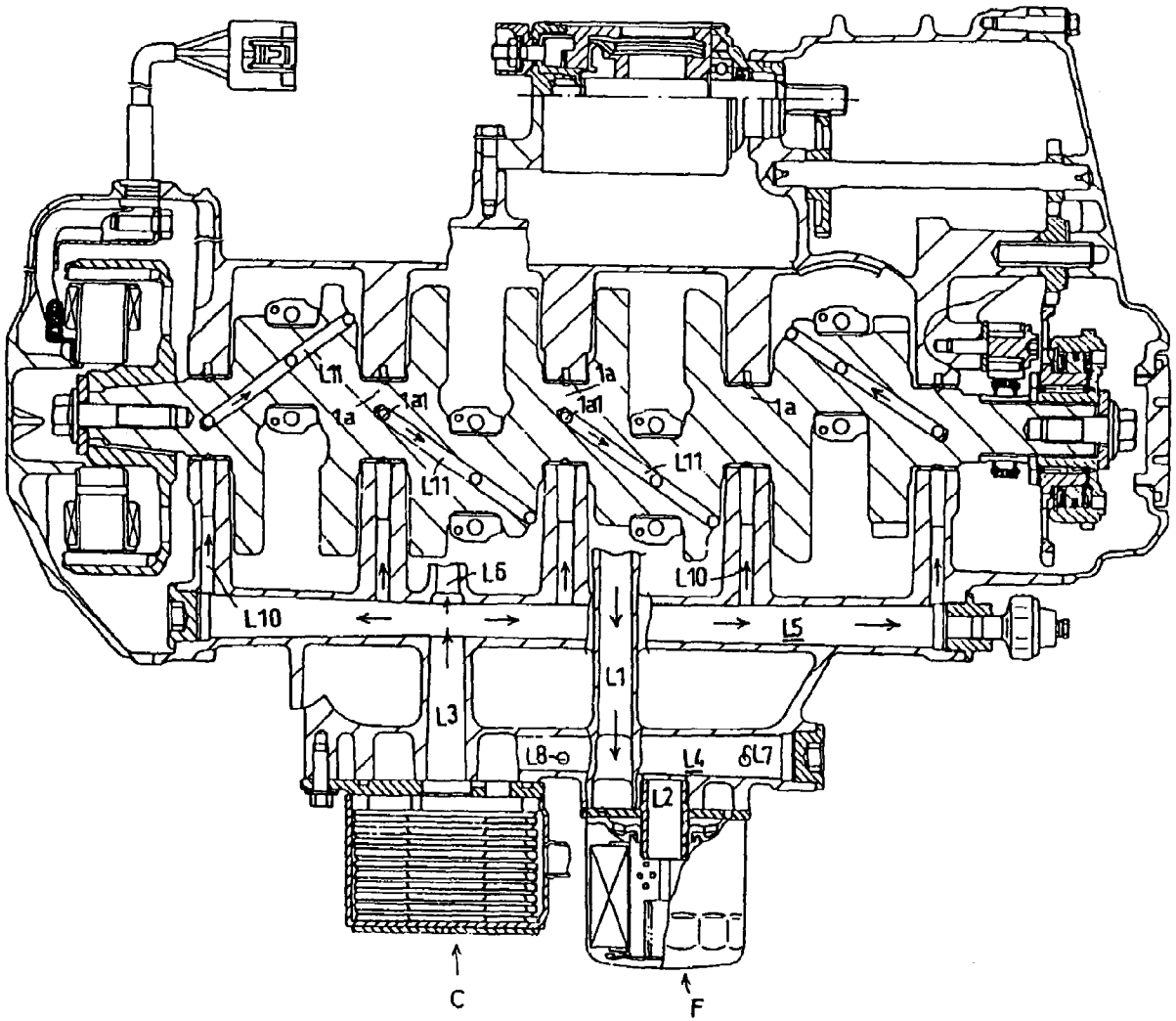
FIG. 5 is a sectional view of another principal portion, showing partially oil supply paths in the internal combustion engine.

As shown in FIGS. 4 and 5, one end of a second oil supply path L2 is connected to an outlet port of the oil filter F, while an opposite end of the second oil supply path L2 is connected to an inlet port of an oil cooler C.

In addition, one end of a third oil supply path L3 is connected to an outlet port of the oil cooler C. The oil supply path L3 is provided with a fourth oil supply path L4 which branches in a direction nearly perpendicular to the oil supply path L3 and is adjacent to the outlet port of the oil cooler C. Further, the oil supply path L3 extends inwardly of the engine E and is connected to a main gallery L5 at a position close to the crank shaft 1. An extending portion of the oil supply path L3 is connected to a branch supply path L6 routed to a transmission M.

The fourth oil supply path L4 which branches in a direction nearly perpendicular to the third supply path L3 at a position adjacent to the outlet port of the oil cooler C extends for a predetermined length in parallel with a front wall portion of the engine E. A branch supply path extends to the cylinder head 30, i.e., a branch supply path L7 extends to a valve operating mechanism including cams 30*e* and a cam shaft 30*f*, and a branch supply path L8 extends to an oil injection pipe L9 (see FIGS. 1 and 2) for the interiors of cylinder bores 21 in the cylinder block 20, are branched from the oil supply path L4.

The main gallery L5 connected to the third oil supply path L3 extends in the lower portion of the crank shaft 1 longitudinally of the crank shaft and in parallel with the same shaft and is provided with branch supply paths L10 extending to a predetermined plural number of places corresponding to the journal bearing portions 1*a* of the crank shaft 1, i.e., five journal bearing portions 1*a* because the engine used in this embodiment is a four-cylinder engine. The branch supply paths L10 are respectively provided with oil outlet openings 1*a*1 (see FIG. 5) in the journal bearing portions 1*a* of the crank shaft 1 and are also provided with branch supply paths L11 extending to connecting portions of the connecting rod large ends 1*d*.

The branch supply path L6 connected to the extending portion of the third supply path L3 and routed to the transmission M once bends downwardly from the extending portion at the front end of the third supply path L3 and extends upwardly (see FIG. 1), and then reaches the position of the main shaft 2 and counter shaft 3 in the transmission and is connected to an oil supply path L61 (see FIG. 2), whereby oil can be fed to the bearing portions and gear engaging portions on the shafts 2 and 3.

The branch supply path L7 branched from the fourth oil supply path L4 and routed to the cylinder head 30, though not clearly shown, extends upwardly as an intra-wall-formed supply path along the front wall portion of the engine E and is connected to an oil supply path (not clearly shown) for the supply of oil to the valve operating mechanism including the cams 30*e* and the cam shaft 30*f*, etc.

The branch path (pipe) L8 (see FIGS. 1, 2 and 4) branched from the fourth oil supply path L4 and extending to the oil injection pipe L9 for the injection oil into the cylinder bores 21 is formed as a branch path (pipe) L8 extending upwardly along the front wall portion of the engine E at a nearly central position in the transverse direction on the front side of the engine E. An upwardly extending end of the branch path L8 extends beyond the crank shaft 1 and reaches a position below the cylinder bores 21. At this height position the extending end of the branch path L8 is connected to the oil injection pipe L9.

Figure 9:
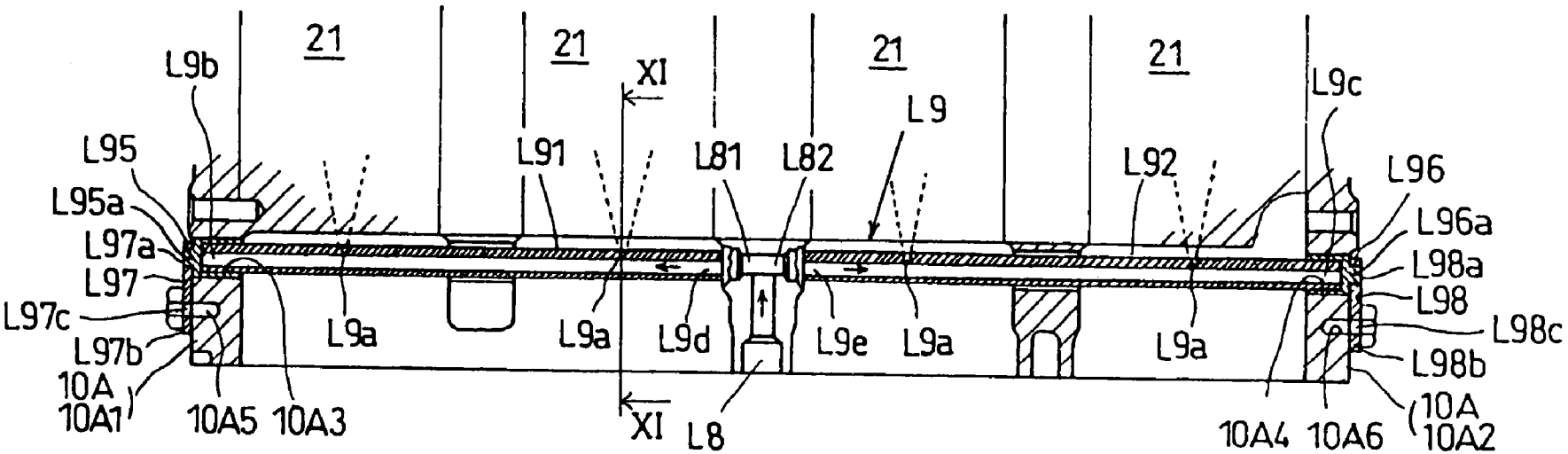
FIG. 9 is an enlarged view of a structural portion where an oil injection pipe as a principal portion in the present invention is disposed.

At the aforesaid height position, the oil injection pipe L9 extends in the transverse direction in FIG. 2 so as to substantially cross the engine E in parallel with the crank shaft 1 although this point will be described later. As shown in FIGS. 2 and 9, the oil injection pipe L9 includes two pipes L91 and L92 that are equal in length and connected to each other at a central position in the aforesaid extending direction. The connection of the pipes L91 and L92 at the central position is effected in the following manner. Inner-end openings of the pipes L91 and L92 are fitted and fixed respectively onto short, T-shaped, right and left pipes L81 and L82 (see FIG. 9) formed at the upper extending end of the branch pipe L8. Thus, the connection of the branch path L8 to the oil injection pipe L9 is substantially in an orthogonal relation to each other.

Figure 8:
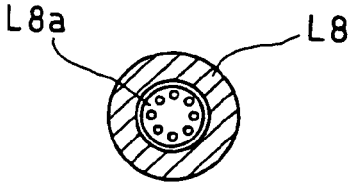
FIG. 8 illustrates an orifice formed in one of the oil supply paths in the present invention.

Oil injection holes L9*a* are formed in the oil injection pipe L9 correspondingly to the cylinder bores 21. Since there are four cylinders in this embodiment, the oil injection holes L9*a* are formed in a total of four positions. The oil injection holes L9*a* are disposed at nearly equal intervals in such a manner that two of them are formed in one of the two right and left pipes L91 and L92 and the remaining two are formed in the other two pipes. In addition, the oil injection holes L9*a* are of the same size and are oriented in the same direction. Such an orifice L8*a* as shown in FIG. 8 (see also FIGS. 1 and 2), which includes a plurality of small holes and exhibits a filtering effect, is formed in an intermediate position of the branch path (pipe) L8 connected to the oil injection pipe L9 to prevent clogging of the oil injection holes L9*a* in the oil injection pipe L9 which will be described later.

As can be seen by reference to FIGS. 2 and 9, the oil injection pipe L9 includes two hollow metal pipes or the like substantially equal in length which are connected together centrally of the pipe L9. The hollow metal pipes are each offset in wall thickness and each have a hollow hole whose outside and inside diameters are offset from each other (see also FIG. 11). As noted above, the oil injection pipe L9 includes pipes extending so as to cross the engine E in parallel with the crank shaft 1.

Figure 11:
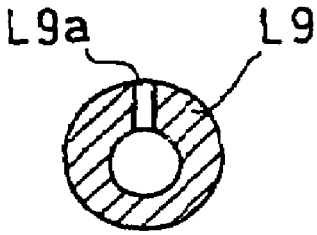
FIG. 11 is a sectional view taken on line XI—XI in FIG. 9.

More specifically, the oil injection pipe L9 extends obliquely upwards of the crank shaft 1, along the front wall portion of the engine E and in parallel with the crank shaft 1, and below the four cylinder bores 21 substantially over the overall length of the crank shaft. In this extending direction the four oil injection holes L9*a* are disposed correspondingly to the cylinder bores 21 and oil is injected through the oil injection holes L9*a* into the cylinder bores 21 from below the cylinder bores at a predetermined angle. In addition, as shown in FIG. 11, the oil injection holes L9*a* are formed in the thick-wall portions of the offset pipes.

The oil injection pipe L9 which extends along the front wall portion of the engine E so as to cross the engine E substantially extends through the upper case 10A of the crank case 10 integral with the cylinder block 20 in a lower portion of the upper case 10A so as to cross the upper case 10A between left and right side walls 10A1 and 10A2. Therefore, through holes 10A3 and 10A4 are formed in the left and right side walls 10A1 and 10A2, respectively (see FIG. 9).

Figure 10:
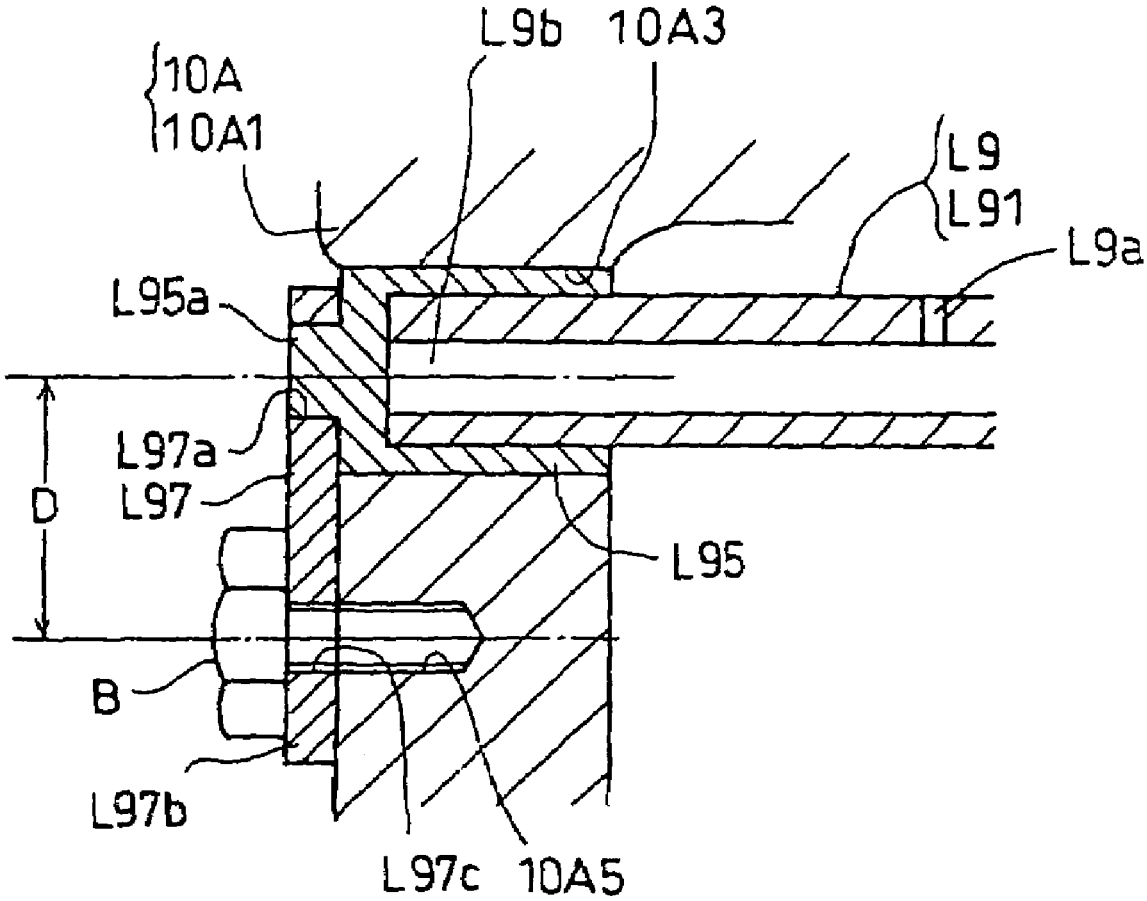
FIG. 10 is a further enlarged view of a principal structural portion in FIG. 9.

As can be seen from FIGS. 9 and 10, in the oil injection pipe L9 in a mounted state thereof, openings L9*b* and L9*c*, formed in both ends of the pipe L9, are positioned within the through holes 10A3 and 10A4, and blind lids L95 and L96 each constituted by a short cylinder closed at one end are fitted at respective inner peripheries over the openings L9*b* and L9*c*, while outer peripheries of the blind lids L95 and L96 are fitted in inner peripheries of the through holes 10A3 and 10A4, whereby the openings L9*b* and L9*c* formed in both ends of the injection pipe L9 are closed with the blind lids L95 and L96 and are held within the through holes 10A3 and 10A4 formed in the left and right side walls 10A1 and 10A2 of the upper case 10A.

The blind lids L95 and L96 which close both-end openings L9*b* and L9*c* of the oil injection pipe L9 have respective boss portions L95*a* and L96*a* formed outside the one-end closed portions of the lids. Mounting stays L97 and L98 are used to substantially finally fix the oil injection pipe L9. Holes L97*a* and L98*a* formed in upper ends of the mounting stays L97 and L98 are press-fitted on the boss portions L95*a* and L96*a*, whereby both are united.

The mounting stays L97 and L98 are each constituted by a generally elliptic plate member of a predetermined thickness and have the holes L97*a* and L98*a* formed in the upper ends of the mounting stays L97 and L98 so as to be press-fitted on the boss portions L95*a* and L96*a* located outside the one-end closed portions of the blind lids L95 and L96. Further, in base portions L97*b* and L98*b* of the mounting stays L97 and L98 there are formed clamping bolt inserting holes L97*c* and L98*c* for fixing the stays L97 and L98 to the outsides of the left and right side walls 10A1 and 10A2 of the upper case 10A.

The oil injection pipe L9 is mounted in the following manner. The blind lids L95 and L96 integral with the mounting stays L97 and L98 are fitted beforehand on the outsides of the left and right pipes L91 and L92, that is, on end portions on the side of the side walls 10A1 and 10A2 of the case 10A in the mounted state of the pipes, then one of the pipes, e.g., the left pipe L91, is first inserted from its inside end, i.e., from its engine interior-side end, through the opening 10A3 of the left side wall 10A1 of the case 10A.

The direction of the oil injection holes L9*a* formed in the pipe L91 is adjusted and an opening L9*d* (see FIG. 9) formed in the inner end of the pipe L91 is temporarily fitted on the left branch portion of the T-shaped connecting portion in the branch supply path L8 without being completely pushed in, and the outer periphery of the blind lid L95, provided at an end portion of the left pipe L91, is temporarily fitted into the opening LA3 formed in the case side wall 10A1 without being completely pushed in.

Thereafter, the direction of the oil injection holes L9*a* formed in the left pipe L91 is adjusted accurately for example by tapping the base portion L97*b* of the mounting stay L97, and the positioning of a tapped hole 10A5 is performed for forming the hole in the case side wall 10A1 at a position corresponding to the bolt inserting hole L97*c* in the stay base portion. In this case, the stay L97 is temporarily turned away from the position where the tapped hole 10A5 is to be formed lest the stay should be an obstacle to the work for forming the tapped hole 10A5.

After the end of the work for forming the tapped hole 10A5, the stay L97 is again returned to the hole forming position and the bolt inserting hole L97*c* formed in the base portion of the stay L97 is aligned with the tapped hole 10A5 thus formed. Then, the joined portion of the stay L97 to the blind lid L95 is pushed while performing the clamping work with clamping bolt B, causing the inner-end opening L9*d* of the pipe L91 to be press-fitted onto the left branch portion L81 of the T-shaped connecting portion. At the same time, the outer periphery of the blind lid L95 at the outer end of the pipe L91 is press-fitted into the opening 10A3 formed in the case side wall 10A1 and the left pipe L91 is mounted by complete tightening of the clamping bolt B.

Thereafter, the other right pipe L92 is inserted from its inner end side through the opening 10A4 formed in the case side wall 10A2 and the direction of the oil injection hole L9*a* is adjusted. More specifically, the direction of the oil injection hole L9*a* is adjusted so as to become the same as the direction of the oil injection hole L9*a* of the left pipe L91 already mounted. Then, the opening L9*e* formed in the inner end of the pipe is temporarily fitted onto the right branch portion L82 of the T-shaped connecting portion without being completely pushed in. Likewise, the outer periphery of the blind lid L96 is temporarily fitted in the outer end of the opening 10A4 of the case wall portion 10A2 without being completely pushed in. Thereafter, the direction of the injection holes L9*a* is adjusted accurately for example by tapping the stay base portion L98*b* and the positioning of the tapped hole 10A6 is performed for forming the same hole in the case wall portion 10A2 at a position corresponding to the bolt inserting hole L97*c* formed in the stay base portion.

Subsequently, by the same procedure as that adopted for the left pipe L91, the tapped hole 10A6 is formed and positioning is performed between the bolt inserting hole L98*c* formed in the stay base portion L98*b* and the tapped hole 10A6, and the pipe L92 is pushed in by pushing the fitting portion between the pipe and the blind lid L96 of the stay L98 while performing a clamping with the clamping bolt B. In this way there is performed not only a press-fitting of the opening L9*e* formed in the inner end of the pipe L92 into the T-shaped connecting portion but also a press-fitting of the outer periphery of the blind lid L96 into the opening 10A4 of the case wall portion 10A2. As a result, the right pipe L92 is united with the left pipe L91 through the T-shaped connecting portion and is mounted firmly to the case wall portion 10A2.

Figure 6:
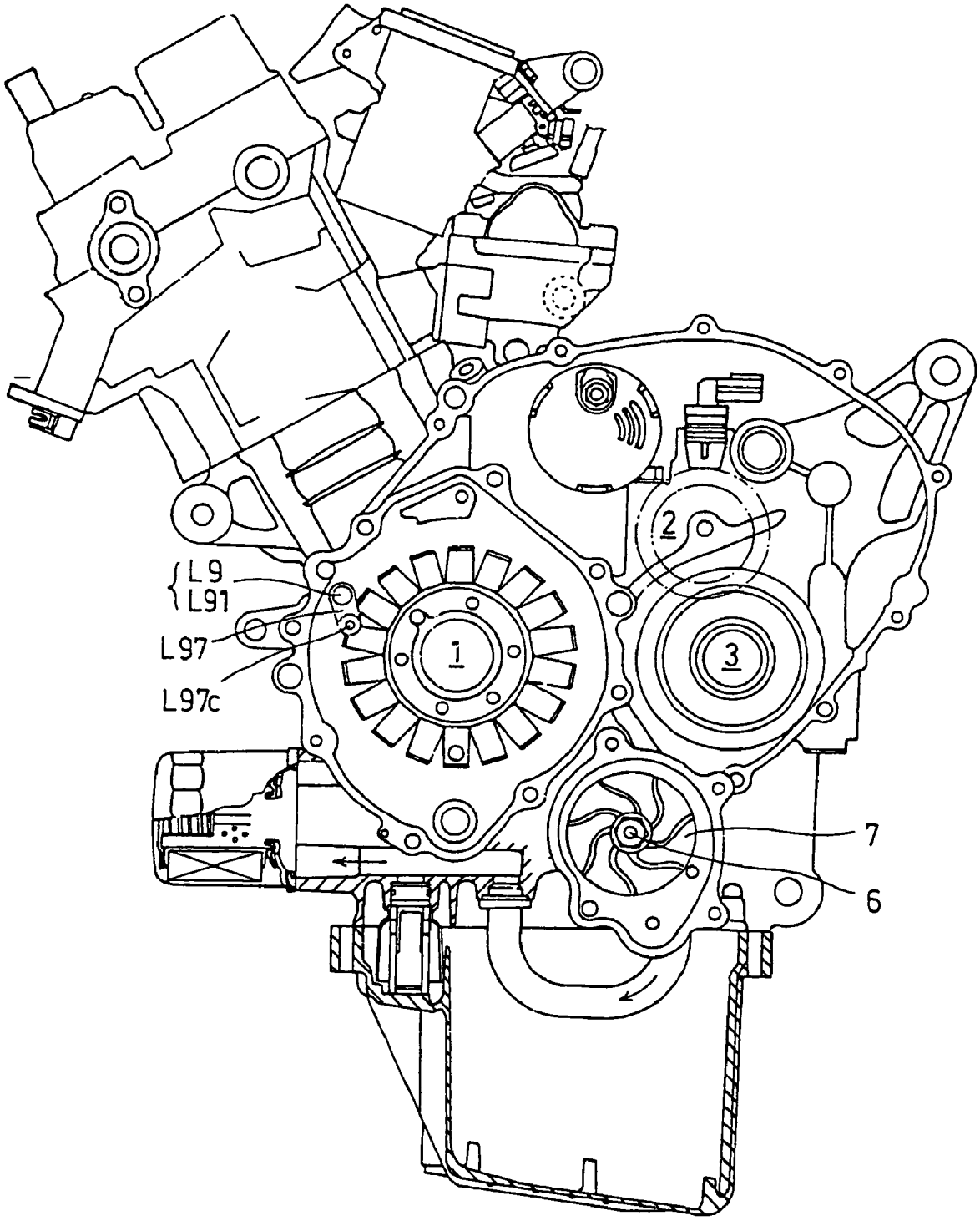
FIG. 6 is a side view of one side of the internal combustion engine, with a cover, etc. removed.
Figure 7:
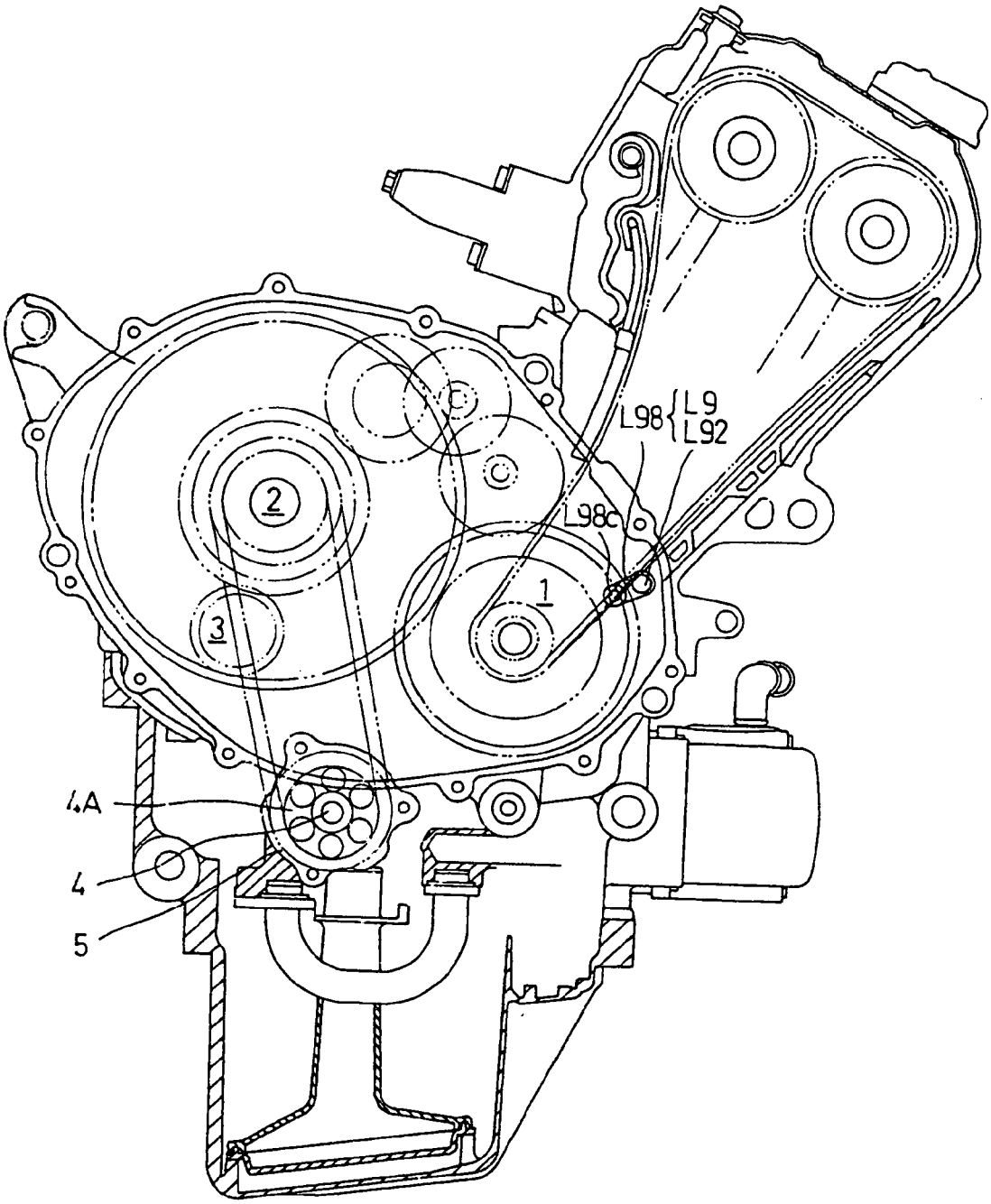
FIG. 7 is a side view of an opposite side of the internal combustion engine, with a cover, etc. removed.

By the mounting of the left and right pipes L91 and L92 described above, a single oil injection pipe L9 having the oil injection holes L9*a* whose position has been accurately adjusted and crossing the engine E in the transverse direction is provided in the engine E. FIGS. 6 and 7 are side views of showing a mounted state of the left and right pipes L91, L92.

The mounting stays L97 and L98 of the oil injection pipe L9 are of different structures at both ends of the oil injection pipe L9. More specifically, the stays L97 and L98 are different in the length D (see FIG. 10) from the fitting holes L97*a* and L98*a* for fitting onto the blind lids L95 and L96 of the oil injection pipe L9 up to the clamping bolt inserting holes L97*c* and L98*c* as mounting portions for mounting to the case side walls 10A1 and 10A2, whereby it is intended to prevent an erroneous mounting of the oil injection pipe L9.

The oil supply structure in the internal combustion engine E used in this embodiment is as described above. With this oil supply structure, oil is fed to various portions of the internal combustion engine E.

More particularly, the oil which has been sucked up from the bottom 10C1 of the oil pan 10C into the oil pump 5 through the oil strainer 8 is pressurized within the oil pump 5 and is discharged from the discharge port 5*b*, and then flows through the first oil supply path L1 into the oil filter F, wherein it is filtered. The oil thus filtered then flows through the second oil supply path L2 into the oil cooler C.

The oil which has thus entered the oil cooler C is cooled within the cooler and flows to the third oil supply path L3 connected to the outlet port of the cooler. But a portion of the oil flowing out from the outlet port flows into the fourth oil supply path L4 which branches from the third oil supply path L3 at a position near the outlet port.

The oil having passed through the third oil supply path L3 then flows to the gallery L5, while a portion thereof flows to the branch path L6 routed to the transmission M. The oil flowing through the main gallery L5 then flows through a plurality of branch paths L10 and is fed to the five journal bearing portions 1*a* on the crank shaft 1 through openings 1*a*1 of the bearing portions 1*a*, and is then further fed to the connecting portions of the large ends 1*d* of the connecting rods 1*c* through the branch paths L11 (see FIG. 5). Further, the oil having passed through the branch path L6 routed to the transmission M further passes through the oil supply path L61 (see FIG. 2) for the supply of oil to the bearing portions on the main shaft 2 and counter shaft 3 and shift gear engaging portions, a part of which oil path is shown, and is fed to those bearing portions and shift gear engaging portions.

On the other hand, a portion of the oil which has entered the oil supply path L4 flows to the branch oil supply path L7 routed to the cylinder head, then flows along the front wall portion of the engine and through the oil supply path L7 as an oil path extending upwardly through the wall portion, and is fed to the valve operating mechanism including the cams 30*e* and the cam shaft 30*f* through an oil supply path formed in the cylinder head though not clearly shown.

The oil which has flowed to the branch supply path L8 connected to the oil injection pipe L9 for the injection of oil into the cylinder bores 21 rises nearly centrally in the transverse direction on the front side of the engine E and along the wall portion of the engine, and is then filtered by the orifice L8*a* at an intermediate position of the branch supply path L8 and reaches the T-shaped connecting portion at the upper extension end of the branch supply path L8 (see FIGS. 1, 2 and 9), and then flows through the left and right pipes L91, L92 of the oil injection pipe L9 and is injected from the oil injection holes L9*a* formed in a pair in the pipe L91 and also in a pair in the pipe L92, that is, from a total of four oil injection holes L9*a*, into the cylinder bores 21 disposed correspondingly to the oil injection holes L9*a* (see FIGS. 2 and 9).

The supply of oil through oil supply paths in the internal combustion engine E is as outlined above.

In this embodiment of the present invention, which has the structure described above, exhibits the following function and effect. The oil injection pipe L9 as an oil injection device for the injection of oil into the cylinder bores 21 is formed as a separate member (separate structural portion) from the structural portions of the internal combustion engine E, so that the efficiency of the work for forming the oil injection holes and oil supply paths can be greatly improved in comparison with the case where the crank case 10 and the cylinder block 20 are directly machined to form the oil injection holes and oil supply paths. More particularly, in the engine of multiple cylinders, the working efficiency can be greatly improved and it is possible to attain a reduction in cost.

Since the oil injection pile L9 is mounted by being inserted from the left and right side walls 10A1 and 10A2 of the engine E so as to extend through the engine, the mounting thereof is easy. In addition, the oil injection holes L91 for the multiple cylinders can be formed in a simple manner and thus the equipment for the injection of oil can be ensured at a low cost.

The oil injection pipe L9 is provided at both ends thereof with its mounting members (mounting stays L97, L98 and blind lids L95, L96) and is mounted through the mounting members to the crank case 10 of the engine E, and the direction of oil injection is determined by determining a relative relation between the oil injection pipe L9 and the mounting members. Therefore, the direction of oil injection depends on the mounting members and can be changed by changing the specification. Further, no special member is needed for the positioning of the oil injection pipe L9.

Moreover, the mounting members (mounting stays L97, L98 and blind lids L95, L96) are provided at left and right ends of the oil injection pipe L9 and are different in the distance from the fitting portion for fitting to the pipe L9 up to the clamping position for the side wall of the mounting members (mounting stays L97, L98). Therefore, it is possible to prevent an erroneous mounting of the oil injection pipe L9.

Since the orifice L8*a* having a plurality of holes of a small diameter is formed in an intermediate position of the oil supply path in communication with the oil injection pipe L9, a filtering effect can be obtained by the small-diameter holes of the orifice L8*a*.

Further, since the outside diameter and the inside diameter of the oil injection pipe L9 are offset from each other and the oil injection holes L9*a* are formed in the thick-wail portion of the oil injection pipe L9, it is possible to ensure an approach-run distance of oil while reducing the diameter of the oil injection pipe L9, thus permitting a reduction in the size and the weight of the oil injection pipe L9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A piston cooling device in an internal combustion engine having a piston cooling structure which injects oil into a cylinder bore comprising:

an oil injection pipe having a plurality of oil injection holes for injection of the oil for cooling a plurality of pistons, wherein said oil injection pipe is disposed on an extension line of said cylinder bore in parallel with a crank shaft in a side view of the engine, and wherein an axial centerline of the oil injection pipe is disposed in position that is higher than an axial centerline of the crankshaft.

2. The piston cooling device according to claim 1, wherein said oil injection pipe is formed separately from a structural portion of said engine and is inserted and mounted in a vehicular transverse direction into a crank case of the engine.

3. The piston cooling device according to claim 1, wherein said oil injection pipe is provided at an end portion thereof with a mounting member for the oil injection pipe and is mounted to a crank case of said engine through said mounting member, and an oil injecting direction is determined by determining a relative relation between said oil injection pipe and said mounting member.

4. The piston cooling device according to claim 2, wherein said oil injection pipe is provided at an end portion thereof with a mounting member for the oil injection pipe and is mounted to a crank case of said engine through said mounting member, and an oil injecting direction is determined by determining a relative relation between said oil injection pipe and said mounting member.

5. The piston cooling device according to claim 3, wherein said oil injection pipe includes a left pipe and a right pipe extending along a common axial line, the left and right pipes being inserted and mounted in a vehicular transverse direction into the crank case, and said mounting member being provided at each of right and left ends of said right and left pipes, the mounting members provided at the right and left ends of the oil injection pipe being different from each other in the distance from the oil injection pipe to each of respective clamping positions.

6. The piston cooling device according to claim 4, wherein said oil injection pipe includes a left pipe and a right pipe extending along a common axial line, the left and right pipes being inserted and mounted in a vehicular transverse direction into the crank case, and said mounting member being provided at each of right and left ends of said right and left pipes, the mounting members provided at the right and left ends of the oil injection pipe being different from each other in the distance from the oil injection pipe to each of respective clamping positions.

7. The piston cooling device according to claim 1, wherein an orifice having a plurality of small-diameter holes is provided in an intermediate position of an oil supply path for the supply of oil to said oil injection pipe.

8. The piston cooling device according to claim 2, wherein an orifice having a plurality of small-diameter holes is provided in an intermediate position of an oil supply path for the supply of oil to said oil injection pipe.

9. The piston cooling device according to claim 3, wherein an orifice having a plurality of small-diameter holes is provided in an intermediate position of an oil supply path for the supply of oil to said oil injection pipe.

10. The piston cooling device according to claim 4, wherein an orifice having a plurality of small-diameter holes is provided in an intermediate position of an oil supply path for the supply of oil to said oil injection pipe.

11. The piston cooling device according to claim 1, wherein a center of an outside diameter and a center of an inside diameter of said oil injection pipe are offset from each other, and said oil injection holes are formed in a thick-wall portion of said oil injection pipe.

12. The piston cooling device according to claim 2, wherein a center of an outside diameter and a center of an inside diameter of said oil injection pipe are offset from each other, and said oil injection holes are formed in a thick-wall portion of said oil injection pipe.

13. The piston cooling device according to claim 3, wherein a center of an outside diameter and a center of an inside diameter of said oil injection pipe are offset from each other, and said oil injection holes are formed in a thick-wall portion of said oil injection pipe.

14. The piston cooling device according to claim 5, wherein a center of an outside diameter and a center of an inside diameter of said oil injection pipe are offset from each other, and said oil injection holes are formed in a thick-wall portion of said oil injection pipe.

15. The piston cooling device according to claim 1, wherein the oil path to said oil injection pipe is an oil path used exclusively for the injection of oil and branching from near a downstream side of an oil filter.

16. The piston cooling device according to claim 2, wherein the oil path to said oil injection pipe is an oil path used exclusively for the injection of oil and branching from near a downstream side of an oil filter.

17. The piston cooling device according to claim 3, wherein the oil path to said oil injection pipe is an oil path used exclusively for the injection of oil and branching from near a downstream side of an oil filter.

18. The piston cooling device according to claim 5, wherein the oil path to said oil injection pipe is an oil path used exclusively for the injection of oil and branching from near a downstream side of an oil filter.

19. A piston cooling device for use in an internal combustion engine comprising:

a piston cooling structure for injecting oil into a cylinder bore;

an oil injection pipe having an oil injection hole for injection of the oil;

said oil injection pipe being disposed on an extension line of said cylinder bore in parallel with a crank shaft in a side view of the engine; and said oil injection pipe being formed separately from a structural portion of said engine and is inserted and mounted in a vehicular transverse direction into a crank case of the engine, wherein an axial centerline of the oil injection pipe is disposed in position that is higher than an axial centerline of the crankshaft.

20. The piston cooling device according to claim 19, wherein said oil injection pipe includes a right pipe and a left pipe, each being provided at an end portion thereof with a mounting member for the oil injection pipe, the left and right pipes being mounted to a crank case of said engine through said mounting members, and an oil injecting direction is determined by determining a relative relation between said oil injection pipe and said mounting members.

* * * * *